United States Patent [19]

Sigourney

[11] Patent Number: 5,002,436

[45] Date of Patent: Mar. 26, 1991

[54] SOIL REINFORCEMENT SYSTEM WITH ADJUSTABLE CONNECTION SYSTEM FOR CONNECTING PRECAST FACING PANELS AND SOIL NAILS

[75] Inventor: James W. Sigourney, Purcellville, Va.

[73] Assignee: Schnabel Foundation Company, Sterling, Va.

[21] Appl. No.: 190,098

[22] Filed: May 4, 1988

[51] Int. Cl.[5] ..... E02D 29/02

[52] U.S. Cl. ..... 405/262; 405/286

[58] Field of Search ..... 405/262, 284, 285, 286; 52/434, 585, 596, 604

[56] References Cited

U.S. PATENT DOCUMENTS

| | | | |
|---|---|---|---|
| 1,965,169 | 7/1934 | Becker . | |
| 2,079,478 | 5/1937 | Bashe . | |
| 3,245,649 | 4/1966 | Cassidy et al. . | |
| 3,466,874 | 9/1969 | Holl | 405/262 |
| 3,802,205 | 4/1974 | Dickinson | 405/286 X |
| 4,073,114 | 2/1978 | Irish . | |
| 4,193,718 | 3/1980 | Wahrendorf et al. | 405/286 |
| 4,272,933 | 6/1981 | Lopes . | |
| 4,329,089 | 5/1982 | Hilfiker et al. | 405/262 |
| 4,343,571 | 8/1982 | Price . | |
| 4,449,857 | 5/1984 | Davis . | |
| 4,596,496 | 6/1986 | Tyrell et al. . | |
| 4,834,584 | 5/1989 | Hilfiker | 405/262 |

FOREIGN PATENT DOCUMENTS

| | | | |
|---|---|---|---|
| 652783 | 3/1929 | France | 405/262 |
| 1076333 | 10/1954 | France | 405/262 |
| 138119 | 7/1985 | Japan | 405/262 |
| 2014222 | 8/1979 | United Kingdom | 405/286 |

*Primary Examiner*—David H. Corbin

*Attorney, Agent, or Firm*—Banner, Birch, McKie & Beckett

[57] ABSTRACT

The present invention is directed to a soil reinforcement system utilizing an adjustable connection between facing panels and soil nails. According to the invention, the face of the excavation is cut and the soil nails are inserted into the ground in a conventional manner. One end of the soil nail will protrude from the excavation face. The facing panels are set in place, spaced from the face of the excavation. Adjustable coupling means are provided for adjustably connecting the soil nail to the facing panel, permitting adjustability in three different degrees of freedom.

19 Claims, 4 Drawing Sheets

SOIL REINFORCEMENT SYSTEM WITH ADJUSTABLE CONNECTION SYSTEM FOR CONNECTING PRECAST FACING PANELS AND SOIL NAILS

TECHNICAL FIELD

The present invention is directed to a system for supporting the sides of excavations. More particularly, the present invention is a system for connecting facing panels and soil nails in a ground reinforcement system for a cut excavation. Specifically, the present invention comprises an adjustable structural connection system permitting three degrees of freedom of adjustment between a facing panel and a soil nail.

BACKGROUND OF THE INVENTION

Soil nailing is a known technique of ground reinforcement for supporting the sides of a cut excavation. This technique involves the insertion into the ground, either in a preformed hole or by percussion, of a reinforcing element, usually a metal rod. Usually the reinforcing elements are grouted to ensure good contact with the ground.

U.S. Pat. No. 3,802,204 is representative of one known method of soil nailing. This patent discloses an array of rows and columns of dowels extending into the cut embankment. The dowels are formed by filling bore holes extending through the skin of the cut face with cement grout and inserting a reinforcing rod into the bore hole before the grout sets. An end portion of the reinforcing rod extends outwardly from the bore hole, beyond the face of the embankment, which allows the dowel to be secured to a beam, effectively tying the entire structure together. A bearing plate may be fitted over the projecting end of the reinforcement rods and fastened, so as to pull the bearing plate against the beam. An outer layer of pneumatically applied concrete, such as shotcrete, typically 4 inches thick, is sprayed over the assembly to complete the retaining structure. The soil reinforcement system does not use precast facing panels. Moreover, the outer layer concrete facing has limited durability and does not present a pleasing appearance.

Soil reinforcement systems using precast concrete facing panels also are known in the art. For example, U.S. Pat. No. 4,449,857 discloses a backfill wall-type soil retaining system. In a backfill wall-type system, the wall is built from the bottom up. The panels are set in place, starting with the bottommost panel. After the panels are set, flexible reinforcements are fixed to the back side of the panels and are then covered with compacted soil, thus raising the soil elevation behind the panels. As each row of panels is added, the process is repeated. The connection system for the wall system disclosed in U.S. Pat. No. 4,449,857 includes a U-shaped anchoring member, which is preferably embedded in the facing panel. Each facing panel is preferably connected to two sets of soil reinforcing wires, although more or less may be employed. Since the reinforcing wires can be placed in the backfill behind the wall at their desired locations, the connection system is not designed to accommodate significant misalignments of the reinforcing wires.

A cut wall-type system, as disclosed and claimed herein, is fundamentally different in construction than a backfill wall-type system. For example, in a cut wall-type system, reinforcements are inserted as the excavation is made, from the top down. In a cut wall-type the panels are erected from the bottom up, similar to a backfill wall-type, but the type of reinforcements and the type of connection system are significantly different. The cut wall-type, as disclosed and claimed herein, has a connection system that can accommodate significant misalignment of the reinforcements. Misalignment must be anticipated since the reinforcements are placed from the top down as the excavation is made. The wall system disclosed and claimed herein does not require the reinforcements to be connected to every panel as does the backfill wall-type disclosed in U.S. Pat. No. 4,449,857. In addition the types of reinforcements disclosed in U.S. Pat. No. 4,449,857 cannot be installed in a natural ground deposit behind a cut.

It is also known to use a soil reinforcement system comprising precast facing panels fixed to soil nails. This known system also has the significant difficulty of aligning the soil nails with their connectors on the facing panels.

SUMMARY OF THE INVENTION

It is an object of the present invention to provide a ground reinforcement system for reinforcing the sides of a cut-type excavation.

Another object of the invention is to provide a ground reinforcement system using a combination of soil nailing and precast facing panels.

It is a further object of this invention to provide a ground reinforcement system utilizing an adjustable connection for adjustably connecting facing panels to soil nails.

Another object of the present invention is to provide a ground reinforcement system with all connections betweeen a soil nail and a facing panel conveniently made behind the back fence of the panel.

The present invention is directed to a ground reinforcement system. Such systems may also be referred to as a soil reinforcement system, the terms being synonymous in this context. The present invention utilizes an adjustable connection between facing panels and soil nails. According to the invention, the face of an excavation is cut and soil nails are installed in the ground in a conventional mammer. One end of the soil nail will protrude from the excavation face. This process of excavating a cut face and installing soil nails is repeated sequentially in descending stages until the full height of the earth cut is reached. Temporary earth retaining means, such as lagging or shotcrete, may be used as necessary to retain the exposed face of the earthen mass. Next, a leveling pad is usually set or cast in place at the bottom of the wall to be built. The facing panels are then set in place on top of the leveling pad, spaced from the face of the excavation. A bearing plate assembly is fixed to the protruding end of the soil nail.

In a preferred embodiment, a D-shaped bracket with generally rectangular cross-section is place over the soil nail and against the excavation face. The soil nail extends through the holes in the front and back faces of the bracket. A nut is threaded onto the threaded end of the soil nail which projects through the front face of the bracket to secure the bracket to the soil nail. Two threaded rods are inserted through vertically elongated slots in the front face of the bracket and are retained in their desired position within the vertical slots by a nut threaded onto the end of the rod, thus providing vertical adjustability in the Y-direction. The threaded rods are attached at their other ends to two horizontally slotted inserts embedded in the facing panel. Again, the rods are retained in their desired position within the horizontal slots by a nut threaded onto the end of the rod, thus providing horizontal adjustability in the X-direction. Each panel has two pairs of inserts and each pair is attached by two threaded rods to one D-shaped bracket. The length of the rods and the engagement of the threaded nuts provides adjustability in the Z-direction, as does the position of their connection in the invention, as further explained below. In addition to the adjustments described above, the threaded rods can pivot in any direction within the slots of the D-shaped brackets and the panel inserts allowing for further adjustment in the X and Y-direction.

Thus, in this preferred form each panel is fixed to four rigid connecting members, i.e., threaded rods, which creates a very stiff, stable configuration. In certain applications, however, more or less than four points of support may be used. In the preferred embodiment of the invention, the threaded rods are connected to alternate vertical columns of panels. No connections are made to intermediate panels. Additionally, all connections between the panels and the rods are on the back face of the panels. In a second embodiment, a first clevis is pivotably attached to the bearing plate assembly and connects the bearing plate assembly to one end of a first rigid connecting member, such as a threaded rod. A second clevis is pivotably attached to the bearing plate assembly and connects the bearing plate assembly to one end of a second threaded rod. The clevises are pivotably attached to the bearing plate assembly so as to provide freedom of adjustment of the threaded rod in the horizontal X-direction. At least two vertically slotted inserts are embedded, during casting of the panel at the manufacturing plant, in the rear side of each facing panel. Each insert receives the other end of one of the threaded rods, which is retained in the insert by a nut engaging a face of the slotted insert. The threaded rods can be slidably adjusted in the vertical Y-direction by appropriate positioning within the vertically slotted insert. The threaded rods are adjustable back and forth in the Z-direction by the threaded engagement of the rods and the clevises. The two threaded rods from each soil nail are connected to two adjacent facing panels. Thus, each facting panel is held by two threaded rods fixed to different soil nails. Once the connections are made, the space between the face of the excavation and the panels is backfilled and any desired drainage material may be provided.

DETAILED DESCRIPTION OF THE PREFERRED EMBODIMENT

Figure 1:
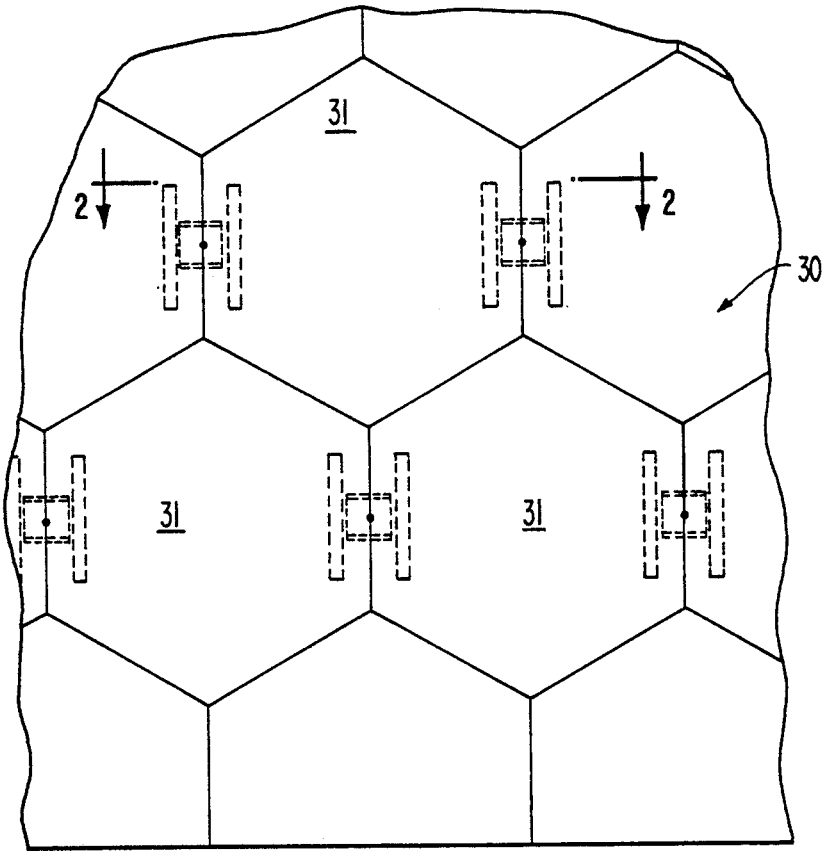
FIG. 1 is a front elevation of the facing panel assembly of a soil reinforcement system illustrating the principle of an adjustable connection system according to the present invention.

A basic embodiment of the soil reinforcement system, utilizing the principle of an adjustable connection permitting three degrees of freedom of adjustment according to the invention, is first shown in FIGS. 1-4. The preferred embodiment of the adjustable connection system in the context of a preferred wall construction is then disclosed in FIGS. 5-9. For convenient reference, the three degrees of freedom of adjustment will be described with reference to an X-Y-Z coordinate, wherein the X-direction refers to the horizontal direction in the plane of the excavated face, the Y-direction refers to the vertical direction in the plane of the excavated face, and the Z-direction refers to a direction perpendicular to the plane of the excavated face.

Referring particularly to the basic embodiment disclosed in FIGS. 1-4, an anjustable connection system 10 is shown. Connection system 10 adjustably connects a soil nail 20 with a facing panel assembly 30. Facing panel assembly 30 is constructed of individual, panels 31. Although hexagonal panels are shown, the invention is not limited to any particular panel shape. Connection system 10 includes a soil nail connection assembly 40 and a facing panel insert 60 connected by threaded rod 70.

Figure 4:
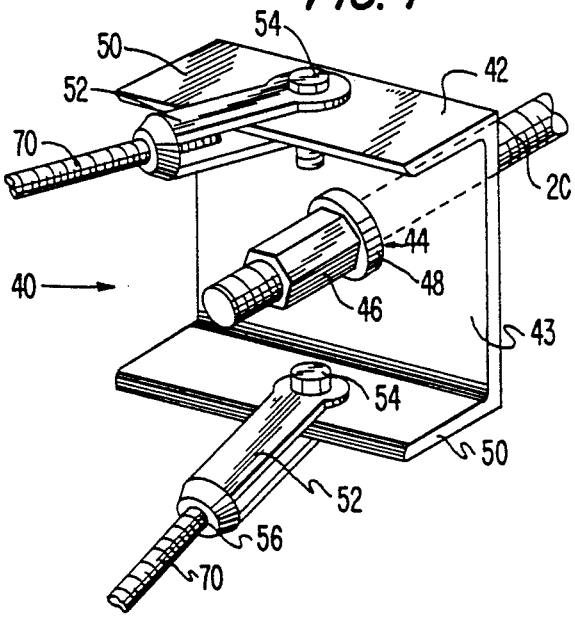
FIG. 4 is a partial perspective view of a clevis and bearing plate assembly fixed to a soil nail and two rigid connection members according to the present invention as shown in FIG. 1.

As shown in FIG. 4, soil nail connection assembly 40 includes a bearing plate assembly 42 having an opening 44 formed in base 43. Bearing plate assembly 42 is fitted over soil nail 20, the protruding end of the soil nail extending through opening 44. A fastener 46 connects bearing plate assembly 42 to soil nail 20. Fastener 46 is preferably a threaded nut and may be used with one or more washers 48. Washers 48 may be beveled to compensate for any angular misalignment of the soil nail or any lack of "plumbness" in the face of the excavation. This adjustment is in addition to the three primary degrees of freedom of adjustment provided by the present invention.

Bearing plate assembly 42 preferably has flanged portions 50 extending outwardly from base 43, so that bearing plate assembly 42 has a substantially U-shaped cross-section. A connection member, such as clevis 52, is pivotably attached by pivot pin 54 to each flange portion 50. Threaded rods 70 are each connected to one of clevises 52. Clevis 52 has threaded hole 56 for receiving the threaded end of threaded rod 70 therein. Clevises 52 pivot horizontally, thus permitting rod 70 to be adjustable in the X-direction. Of course, additional clevises may be fixed to bearing plate assembly 42 is more than two rods per each facing panel 31 are needed.

Figure 3:
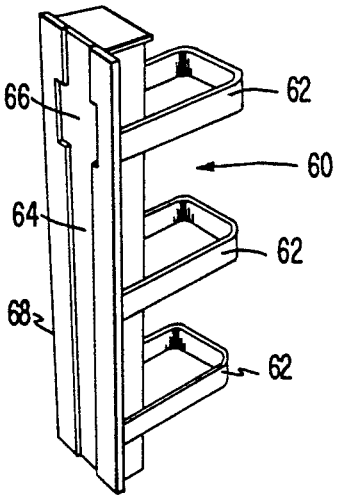
FIG. 3 is a perspective view of a facing panel insert of the present invention as shown in FIG. 1.
Figure 2:
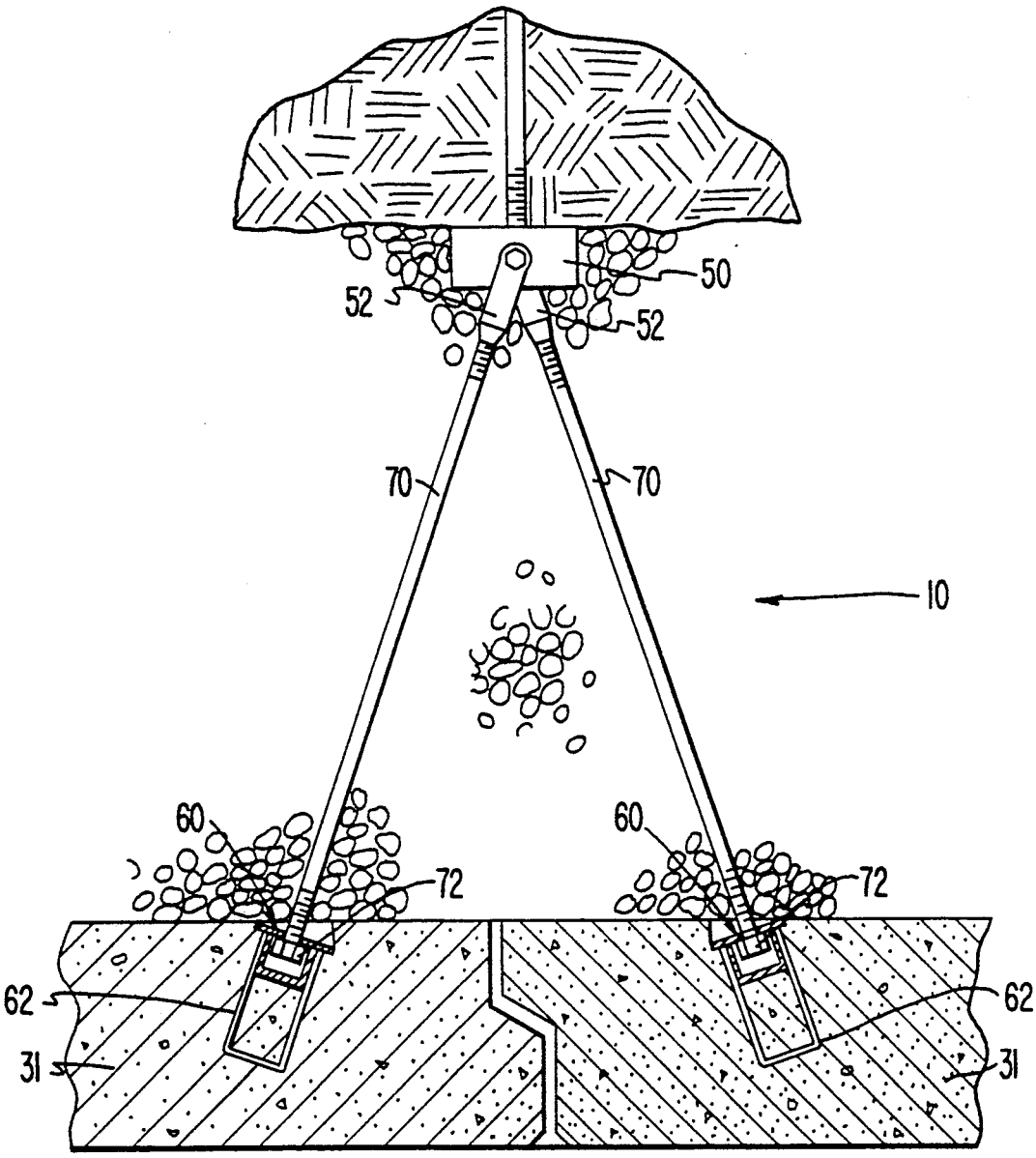
FIG. 2 is a top plan view of a soil reinforcement system as shown in FIG. 1

Facing panel insert 60 connects facing panel assembly 30 to rod 70. Facing panel insert 60 is preferably a slotted insert member, as shown in FIG. 3. Panel insert 60 is embedded in the rear face of each concrete facing panel 31 during casting of the panel. Each panel 31 preferably has two such inserts embedded therein, corresponding to the number of rods 70. Insert 60 has embedment anchors 62 which facilitate a secure connection within the concrete once it has cured. Insert 60 has a vertically elongated slot 64 with a wide opening portion 66 in rearwardly facing surface 68, that is, the surface facing the space between facing panel assembly 30 and the excavated face. As shown in FIG. 2, insert 60 is fixed to the rear face of each panel 31 by embedding insert 60 at an angle with respect to the plane of the rear face to permit insertion of the end of the threaded rod into the slot substantially perpendicular to surface 68 of insert 60.

Preferably, rod 70 is a threaded rod or other rigid connection member having an enlarged head 72, preferably in the form of a hex-head. The head 72 of rod 70 is inserted into wide opening portion 66 of slotted insert 60 and then moved within slot 64 to its desired position, where it will be retained by head 72 engaging the walls slot 64. Thus, vertically elongated slot 64 allows rod 70 to be adjusted in the Y-direction. Of course, to detach the rod from slotted insert 60, head 72 is moved within slot 64 to wide opening portion 66 through which it may be removed.

The adjustability of system 10 in the Z-direction is provided by the threaded engagement of rod 70 with threaded hole 56 of clevis 52 which varies the operative length of rod 70. Additional adjustability may be achieved by varying the length of rod 70. Field installation of the assembly will merely require cutting a desired length of a continuously threaded rod from stock and attaching it as described to insert 60 and clevis 52 to fix its operative length. Further adjustment in the Z-direction also can be provided by allowing bearing plate assembly 42 to be adjustably connected to soil nail 20, i.e., bearing plate assembly 42 may have a fastener placed on either side of it to secure the bearing plate assembly in a position spaced from the face of the excavation.

In constructing a wall using the present invention, a cut surface is excavated just beyond, or behind, the predetermined surface of the wall. The soil nails are positioned on the excavation face approximately across from the planned vertical intersection of two adjacent panels 31, as shown in FIG. 1. One rod 70 from each bearing plate assembly 42 is attached to panel 31 to the right of bearing plate assembly 42 and the other rod 70 is attached to panel 31 to the left of bearing plate assembly 42. In this way, each soil nail 20 is attached to two adjacent panels and each panel 31 is held by two soil nails 20, thus providing a strong, secure attachment.

Additional clevises 52 and rods 70 can be used to provide an even stronger connection. The number and positioning of soil nail connection assemblies 40 is determined by the soil, load, and other factors. Depending on the number of rigid connection members, e.g., rods, facing panel inserts 60 may need to be elongated or otherwise reconfigured in shape or number to accommodate the additional rods.

Figure 5:
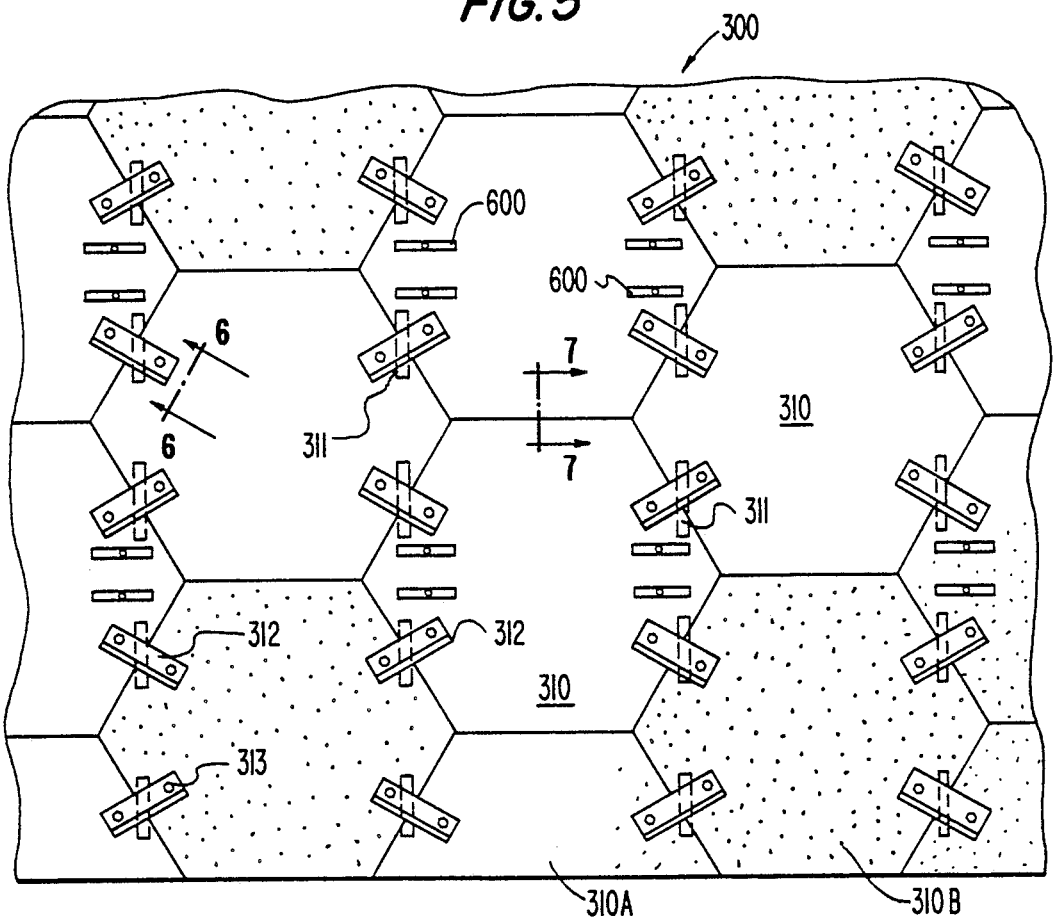
FIG. 5 is a rear elevation of the facing panel assembly of a soil reinforcement system according to the preferred embodiment of the present invention.
Figure 6:
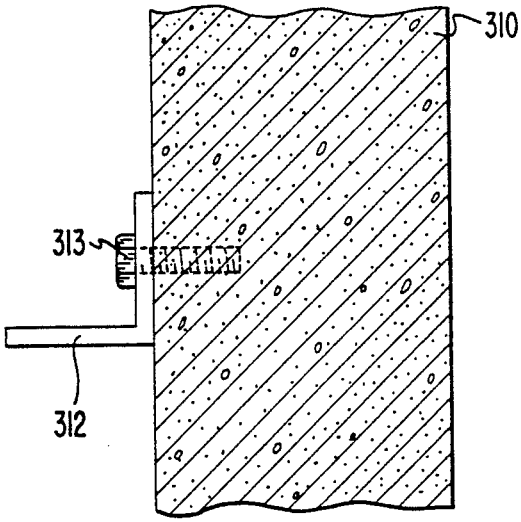
FIG. 6 is a sectional view along the line 6—6 in FIG. 5.
Figure 7:
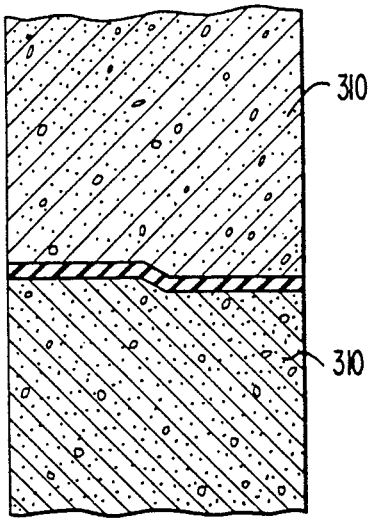
FIG. 7 is a sectional view along the line 7—7 in FIG. 5.

The preferred embodiment of the soil reinforcement system of the present invention is shown with reference to FIGS. 5–9. In this embodiment, clevis assemblies 52 have been eliminated. Additionally, the system shown in FIGS. 5–9 vertically aligns the facing panels and creates stiff, vertical columns, by attaching the soil nails to alternate columns of panels. Panels adjacent to the vertical column fixed panels form a vertical intermediate column, the panels of which are not fixed to the soil nails but are supported only by the adjacent panels. Although the panels shown in FIG. 5 are hexagonal, the invention is not limited to panels of any particular shape.

In FIGS. 5, facing panel assembly 300 is shown including individual panels 310. Panels 310 are arranged to form vertical columns, that is, panels 310 are arranged one above the other. As shown and as further described below, two different columns of panels are created. A stiff, vertical column 310A of panels fixed to soil nail connection assemblies 400, and a vertical column 310B of "intermediate" panels which are not fixed to soil nail connection assemblies 400 but are supported only by adjacent panels. As shown, the panels in intermediate column 310B are the same size as the panels in column 310A. However, the present invention is not so limited and the panels in intermediate column 310B may be larger or smaller than the panels in column 310A.

As shown in FIG. 5, a vertical slot extends through a portion of each side of panels 310 and an aligment dowel 311 may be fixed in these slots to align panels 310 in the vertical direction. Dowels 311 help to maintain the alignment when facing panel assembly 300 is constructed. Alignment dowels 311 preferably are not continuous.

Preferably, four L-shaped brackets 312 are provided for each facing panel 310 and serve to connect several of the interfaces of adjacent panels. The location, number and orientation of brackets 312 will , of course, vary depending upon size and shape of the panels, load on the wall, and several other factors unique to each project. In the embodiment shown in FIG. 5, each L-shaped bracket 312 provided with two bolts 313 which are threaded into threaded inserts embedded in facing panels 310. Each bolt 313 of a single bracket 312 is embedded in one of two neighboring panels and serves to connect L-shaped brackets 312 with facing panels 310. In this manner, neighboring panels 310 are held together by L-shaped brackets 312, as shown in FIG. 5.

Figure 8:
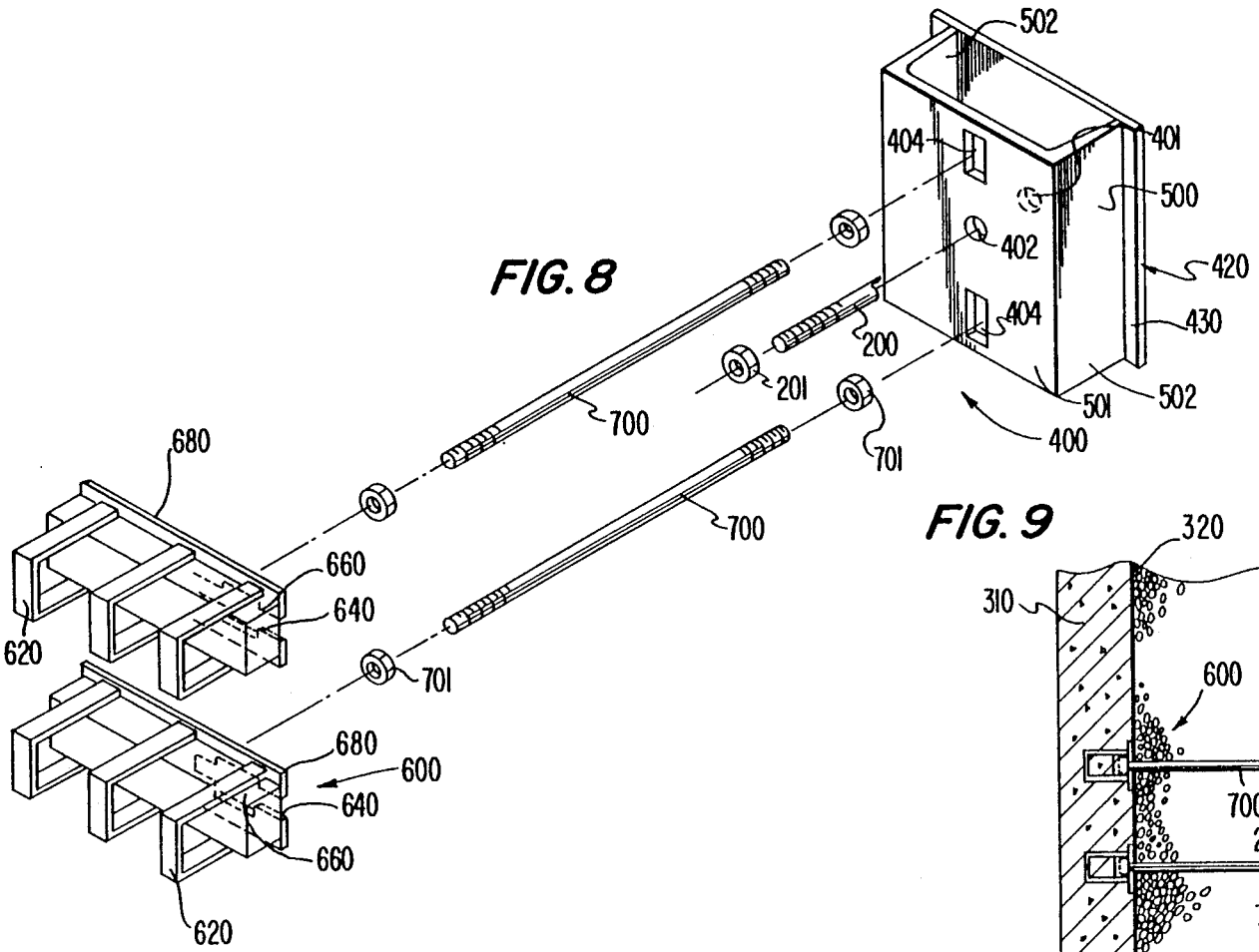
FIG. 8 is a perspective view of a pair of pacing panel inserts and a soil nail assembly according to the preferred embodiment of the present invention.
Figure 9:
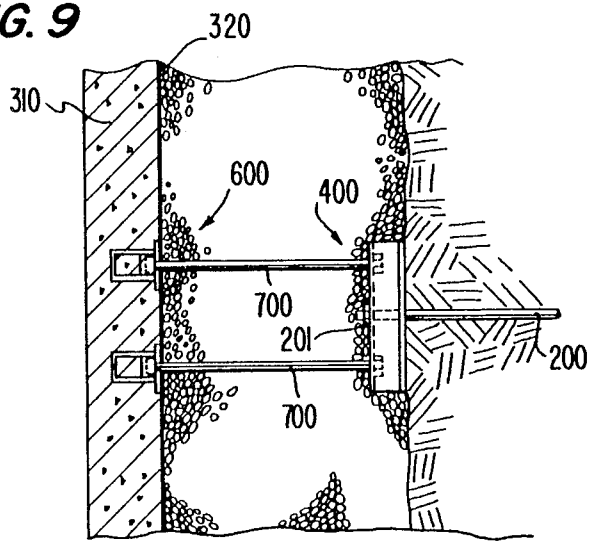
FIG. 9 is a section view of a soil reinforcement system according to the preferred embodiment of the present invention.

With reference to FIG. 9, panel insert 600 is shown with soil nail connection assembly 400 in the preferred embodiment of the present invention. As shown in FIGS. 8 and 9, inserts 600 are embedded in individual concrete facing panels 310, preferably at the time of manufacturing. Embedment anchors 620 facilitate a secure connection to panels 310. Panel inserts 600 are embedded in facing panels 310 such that their rear faces 680 are parallel with rear face 320 of facing panels 310. Preferably, inserts 600 are embedded horizontally in facing panels 310, that is, horizontal slots 640 of inserts 600 extend along the X-direction. Slots 640 have wide opening portions 660.

Panels 310 in stiff, vertical column 310A are attached to soil nail connection assembly 400 by rigid connection members, such as threaded rods 700 and nut 701. Rods 700 are inserted into wide opening portions 660 of inserts 600 in a similar manner as shown with respect to insert 60 in FIG. 2, and rods 700 are moved to a desired horizontal position where they are retained by engagement of nut 701 against the walls of slots 640. Thus, horizontal slots 640 allows rods 700 to be adjusted in the X-direction. In the preferred embodiment, four inserts 600 are embedded in each facing panel 310, although it is apparent that a different number could, of course, be used. Also, positioning of inserts 600 could vary from that shown in FIG. 5, depending on load and other design factors. The panels in intermediate column 310B are not fixed to soil nail connection system 400. They are retained in place by adjacent panels and brackets 312.

Soil nail connection assemblies 400 include a roughly D-shaped bracket 200 with a rectangular cross-section as shown in FIG. 8, and which has rear plate 430 with front bracket 500 attached thereto. Front bracket 500 has front plate 501 parallel to rear plate 430 and two flanges 502 extending perpendicularly thereto. Rear plate 430 has centrally located opening 401 which is coaxial with opening 402 in front plate 501. Front plate 501 further includes two vertically elongated slots 404 which are located above and below hole 402.

Soil nail 200 is installed into the ground. Soil nail connection assembly 400 is attached to soil nail 200 by extending the threaded end of soil nail 200 through openings 401, 402 and fixing the assembly 400 to soil nail 200 by a nut 201 threaded onto the threaded end of soil nail 200. This is repeated as each stage of excavation proceeds, until the bottom is reached. A leveling pad is put in position at the bottom of the excavation and the bottom row of panels 310 is set in place and connected as described below. A backfill is then put in place and the process of placing and connecting panels and backfilling is repeated until the full wal height is achieved.

Soil nail connection assembly 400 is connected to insert 600 by rods 700 as shown in FIG. 8. One end of rods 700, fits through each of slots 404 and is held in place by nuts 701. Vertically elongated slots 404 allow for Y-direction adjustment between soil nail assembly 400 and slotted insert 600. The other end of rods 700 fits through wide opening portion 660 of horizontal slots 640 in rear face 680 of insert 600 are horizontally adjusted in slots 640 to a desired position. Thus, adjustability in the X-direction is provided since inserts 600 are fitted horizontally in facing panels 310.

The angular position or rods 700 with respect to either assembly 400 and insert 600 is accommodated because rods 700 can pivot in any direction within the slots. A nut 701 having a rounded face may be used to facilitate the angular positioning of rods 700. Thus, the angular position, horizontal position, and vertical position of rods 700 may be adjustably fixed.

Z-direction adjustability is provided by the threaded engagement of rods 700 with nuts 701 and by the length of rods 700. Field installation will merely require cutting a desired length of a continuously threaded rod from stock and attaching it as described. Additionally, adjustment in the Z-direction can be provided by allowing assembly 400 to be adjustably connected to soil nail 200, that is, front plate 501 may be provided with fasteners placed on either side of it to secure it in a position spaced from the face of the excavation.

The soil reinforcement system of the present invention does not require any field welding, since all connections are threaded and slide connections. Additionally, all panel connections are conveniently located on the backside of the facing panels.

The foregoing description is for illustrative purposes only. Modifications may be made particularly with regard to matters of size, shape and arrangement of parts within the scope of the invention as defined by the appended claims.

I claim:

1. A soil reinforcement system comprising:

at least one soil nail installed into a substantially vertical cut face of an excavation;

at least two facing panels for supporting the vertical cut face of the excavation; and adjustable connection means for adjustably connecting said soil nail to at least one of said facing panels, said connection means comprising rigid connection members connecting said panels and said soil nail, said connection means permitting three degrees of freedom of adjustment between said panels and said soil nail.

2. A soil reinforcement system as recited in claim 1 wherein said adjustable connection means comprises a soil nail connection assembly comprising a substantially D-shaped bracket, said bracket having at least one slot for receiving one end of said rigid connection members, the position in one plane and operative length of said rigid connection member adjustably fixed within said slot.

3. A soil reinforcement system as recited in claim 2 further comprising panel inserts fixed to said one facing panel, said inserts comprising a slot for receiving the other end of said rigid connection member, the position in a second plane and operative length of said rigid connection member adjustably fixed within said slot.

4. A soil reinforcement system as recited in claim 1 further comprising a plurality of soil nails installed into the cut face of an excavation, a plurality of facing panels vertically aligned in a plurality of columns, a plurality of adjustable connection means for adjustably connecting each of said soil nails to said panels in alternate columns of said plurality of vertical columns, thereby creating alternate columns of panels connected to said soil nails and columns of panels not connected to said soil nails.

5. A soil reinforcement system as recited in claim 5 wherein said facing panels include alignment means for vertically aligning said panels in each of said columns.

6. A soil reinforcement system as recited in claim 5 wherein said alignment means comprises vertical slots in each of said panels in each column vertically aligned with vertical slots in each adjacent column, and a rigid rod fixed in said vertically aligned slots.

7. A soil reinforcement system as recited in claim 4 wherein said adjustable connection means further comprises a soil nail connection assembly adjustably connected to said soil nails and a plurality of panels inserts fixed to said connected alternate columns of panels;

said soil nail connection assemblies each having a plurality of adjustment slots, said panel inserts each having an adjustment slot;

said rigid connection members comprising threaded rods;

one end of each of said threaded rods extending through one of said adjustment slots of said soil nail connection assembly and adjustably connected thereto, the other end of each of said threaded rods extending through one of said adjustment slots in said panel inserts and adjustably connected thereto.

8. A soil reinforcement system as recited in claim 1 wherein said adjustable connection means further comprises a soil nail connection assembly fastened to said soil nail, said assembly comprising first and second pivotable connection members for permitting adjustment of said rigid connection members in one degree of freedom, and adjustable coupling means for coupling one of saaid rigid connection members to each of said pivotable connection members thereby permitting adjustment in a second degree of freedom.

9. A soil reinforcement system as recited in claim 8, wherein said soil nail connection assembly further comprises a bearing plate assembly having a base portion and outwardly extending flange portions, and wherein said base portion is fixed to said soil nail.

10. A soil reinforcement system as recited in claim 9, wherein said first pivotable connection member is pivotably connected to one of said flange portions of said bearing plate assembly and said second pivotable connection member is pivotably connected to the other of said flange portions of said bearing plate assembly.

11. A soil reinforcement system as recited in claim 10 wherein each of said first and second pivotable members comprises a clevis.

12. A soil reinforcement system as recited in claim 8 wherein said adjustable connection means further comprises a facing panel insert fixed in each of said facing panels for adjustably connecting said rigid connection members to said facing panels so that said rigid connection members are adjustable with respect to said facing panels in a third degree of freedom.

13. A soil reinforcement system as recited in claim 12 wherein said facing panel insert comprises a slot, one end of each said rigid connection members adjustably retained within said slot to thereby allow adjustment of said rigid connection members with respect to said facing panels.

14. A method of connecting facing panels to soil nail to support the face of an excavation, said method comprising the steps of:

excavating a cut just beyond the predetermined surface of a wall;

installing a plurality of soil nails into the cut so that one end of the soil nail protrudes from the cut;

fixing a soil nail connection assembly to the protruding end of each soil nail, said soil nail connection assembly having an adjustable connection member;

setting panels in place to form a wall spaced from said cut;

adjustably coupling one end of a rigid connection member to said adjustable connection member; and adjustably coupling the other end of said rigid connection member to at least some of said panels so that said soil nails are coupled to said panels with three degrees of freedom of adjustment.

15. A method as recited in claim 14 wherein said step of adjustably coupling one end of said rigid connection member to said connection assembly comprises coupling so that said rigid connection member is adjustable with respect to said soil nail in two different degrees of freedom, and wherein said step of adjustably coupling the other end of said rigid connection member comprises coupling so that said rigid connection member is adjustable in a third degree of freedom thereby facilitating connecting said soil nails and said facing panels.

16. An adjustable connection system for adjustably connecting a soil nail to a facing panel comprising:

a soil nail connection assembly adapted to be fixed to a soil nail installed into the cut face of an excavation;

a facing panel insert adapted to be fixed within the facing panel; and at least one rigid connection member adapted to connect said soil nail connection assembly and said facing panel insert, one end of said rigid connection member adapted to be adjustably fixed to said soil nail connection assembly so that the operative length and position of said rigid connection member in one place can be varied, the other end of said rigid connection member adapted to be adjustably fixed to said facing panel insert whereby the operative length and position of said rigid connection member in another plane can be varied, whereby three degrees of freedom are provided for connecting the facing panel to the soil nail.

17. A soil reinforcement system comprising:

a plurality of soil nails installed into the cut face of an excavation;

a plurality of facing panels vertically aligned in a plurality of vertically adjacent columns;

a plurality of adjustable connection means for adjustably connecting said soil nails to said panels, said soil nails connected only to panels in alternate vertical columns of said plurality of vertical columns, thereby creating alternate columns of panels connected to said soil nails and columns of panels not connected to said soil nails.

18. A soil reinforcement system as recited in claim 17 wherein said adjustable connection means comprises a soil nail connection assembly fastened to each of said soil nails and rigid connection members connecting said assemblies and said facing panels, said soil nail connection assembly comprising a bracket having at least one slot for receiving one end of said rigid connection members, the posiiton in one plane and operative length of said rigid connection members adjustably fixed within said slot.

19. A soil reinforcement system as recited in claim 18 further comprising facing panel inserts fixed to said facing panels, said inserts comprising a slot for receiving the other end of said rigid connection members, the position in a plane different from said one plane and operative length of said rigid connection members adjustably fixed within said slot.

* * * * *